US008938970B2

(12) United States Patent
Gerendas et al.

(10) Patent No.: US 8,938,970 B2
(45) Date of Patent: Jan. 27, 2015

(54) GAS-TURBINE COMBUSTION CHAMBER WITH STARTER FILM FOR COOLING THE COMBUSTION CHAMBER WALL

(75) Inventors: Miklos Gerendas, Am Mellensee (DE); Sermed Sadig, Berlin (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 1102 days.

(21) Appl. No.: 12/815,829

(22) Filed: Jun. 15, 2010

(65) Prior Publication Data

US 2011/0011093 A1 Jan. 20, 2011

(30) Foreign Application Priority Data

Jul. 17, 2009 (DE) ..... 10 2009 033 592

(51) Int. Cl.
*F02C 1/00* (2006.01)
*F23R 3/06* (2006.01)

(52) U.S. Cl.
CPC ..... *F23R 3/06* (2013.01); *F23R 2900/03042* (2013.01)
USPC ..... 60/752; 60/796; 60/804

(58) Field of Classification Search
USPC ..... 60/752–760, 796, 804
See application file for complete search history.

(56) References Cited

U.S. PATENT DOCUMENTS 3,420,058 A 1/1969 Howald et al.
4,566,280 A 1/1986 Burr
4,651,534 A 3/1987 Stroem
4,693,074 A * 9/1987 Pidcock et al. ..... 60/740
5,142,871 A 9/1992 Lampes et al.
5,181,379 A 1/1993 Wakeman et al.
5,279,127 A * 1/1994 Napoli ..... 60/754
5,329,761 A * 7/1994 Ablett et al. ..... 60/804
5,435,139 A 7/1995 Pidcock et al.
5,623,827 A 4/1997 Monty
5,894,732 A 4/1999 Kwan
5,956,955 A * 9/1999 Schmid ..... 60/748
6,035,645 A 3/2000 Bensaadi et al.
6,266,961 B1 * 7/2001 Howell et al. ..... 60/752

(Continued)

FOREIGN PATENT DOCUMENTS

DE 10214573 10/2003
EP 0434361 6/1991

(Continued)

OTHER PUBLICATIONS

German Search Report dated Aug. 12, 2010 from counterpart foreign application.

*Primary Examiner* — John K Fristoe, Jr.
*Assistant Examiner* — Daphne M Barry
(74) *Attorney, Agent, or Firm* — Timothy J. Klima; Shuttleworth & Ingersoll, PLC

(57) ABSTRACT

A gas turbine combustion chamber has a starter film for cooling the combustion chamber wall, and a combustion chamber head, into which cooling air can be introduced and which is confined to the combustion chamber by a heat shield (5). A base plate (2) is arranged at a certain distance from the heat shield (5) and the base plate (2) is provided with several openings (6) in its rim area for passing the cooling air. Center axes (17) of the openings (6) are inclined at a shallow angle (α) relative to the combustion chamber wall (4).

15 Claims, 7 Drawing Sheets

(56) References Cited

U.S. PATENT DOCUMENTS

Figure 1:
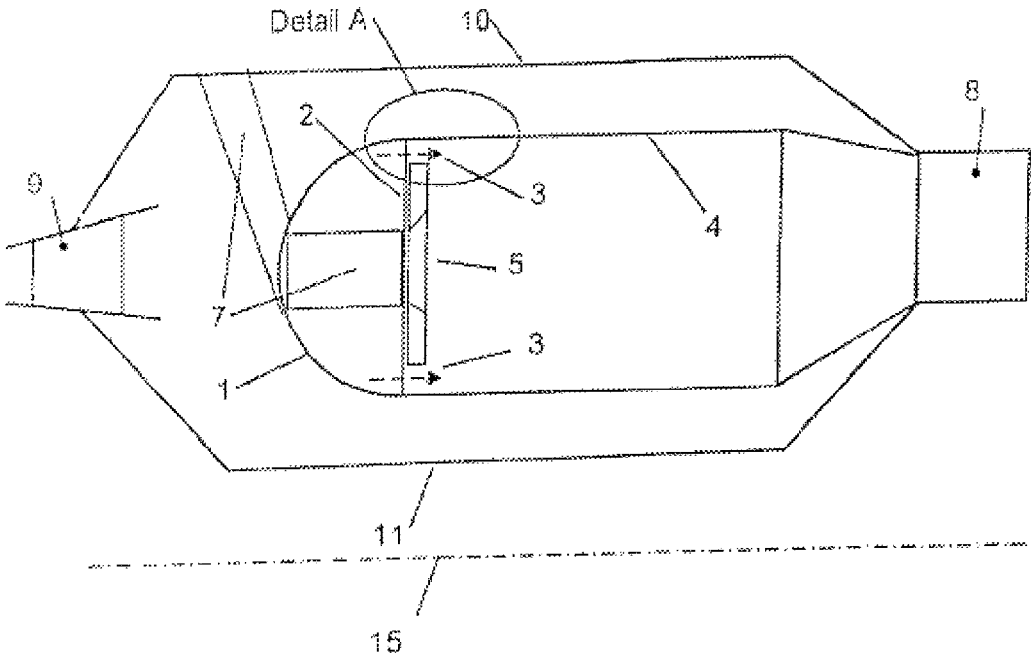

| | | | | |
|---|---|---|---|---|
| 6,546,732 | B1 * | 4/2003 | Young et al. | 60/772 |
| 6,546,733 | B2 | 4/2003 | North et al. | |
| 6,955,053 | B1 | 10/2005 | Chen et al. | |
| 7,124,588 | B2 | 10/2006 | Gerendas et al. | |
| 7,260,936 | B2 | 8/2007 | Patel et al. | |
| 2003/0182943 | A1 * | 10/2003 | Gerendas et al. | 60/754 |
| 2006/0042271 | A1 | 3/2006 | Morenko et al. | |

FOREIGN PATENT DOCUMENTS

| | | |
|---|---|---|
| EP | 1098141 | 5/2001 |
| EP | 1705426 | 9/2006 |

* cited by examiner

State of the art

GAS-TURBINE COMBUSTION CHAMBER WITH STARTER FILM FOR COOLING THE COMBUSTION CHAMBER WALL

This application claims priority to German Patent Application DE102009033592.7 filed Jul. 17, 2009, the entirety of which is incorporated by reference herein.

This invention relates to a gas turbine combustion chamber with starter film for cooling the combustion chamber wall.

The combustion chamber wall encloses a space in which fuel is burnt with the air compressed by the compressor before it is expanded in the turbine to deliver power. The combustion chamber wall must be suitably cooled since the gas temperatures in the combustion chamber generally exceed the melting temperature of the wall material. To ensure a long service life, temperature limits far below the melting temperature must be respected. The combustion chamber may, for example, be equipped with cooling rings (U.S. Pat. No. 4,566,280), effusion holes (U.S. Pat. No. 5,181,379), pinned tiles (EP 1 098 141 A1) or impingement and effusion-cooled tiles (U.S. Pat. No. 5,435,139).

Independently of the cooling method selected, the combustion chamber wall must be protected upstream of the first cooling air inlet, since cooling of the rear side alone is inadequate to keep the temperature level below the applicable limit. Therefore, a so-called starter film is usually applied to the forward part of the combustion chamber wall. This starter film protects the combustion chamber wall until the cooling method actually used has sufficient effect. The air required for this starter film can be supplied from within a space formed by a hood and a base plate or from an annulus between the combustion chamber wall and the combustion chamber casing. The openings in the combustion chamber wall are mostly circular, evenly distributed holes vertically arranged to the surface. The starter film is mainly introduced parallel to and along the combustion chamber wall. The gap from which the circumferentially evenly distributed cooling film discharges is formed by a cooling ring. Such a starter film for an effusion-cooled wall is provided in specification U.S. Pat. No. 5,279,127.

In another design of the art, the air is conducted only on one side by way of an element belonging to the combustion chamber wall, while, on the other side, it is confined by a flow surface of the heat shield. The starter film is blown out between the heat shield and the initial portion of the combustion chamber wall (see FIG. 1), to protect this part of the combustion chamber against the hot combustion gases. This is usually accomplished by a number of circular holes arranged on a specific pitch circle. In order to equalize the individual jets to form a cooling film, the air is initially blown onto the rear side of the heat shield. Upon impingement, the jets will cool the heat shield and combine into a homogenous film which then flows parallel to the combustion chamber wall at a certain distance from the latter. The size of the holes, their spacing on the pitch circle or the number of pitch circles is adapted to the cooling capacity that is locally required. Such a starter film is known from DE 102 14 573 A1.

As a means of and increasing the stability of and enhancing the cooling effect on the heat shield, fins can be provided on that part of the heat shield that conducts the air for the starter film, as known for example from Specification DE 44 27 222 A1 or DE 195 08 111 A1. The fins shown there do not extend radially beyond the lip of the heat shield. In particular with effusion cooling of the wall, which can be single-walled or additionally provided with impingement-cooled tiles, the air flowing through the wall or the tiles, respectively, will build up a protective cooling film only after a certain downstream distance. Without a starter film, the initial part of the wall would not be adequately protected.

In Specification U.S. Pat. No. 3,420,058, the direction of the cooling air is, upon production of the cooling air holes, changed such by deformation of the staged combustion chamber wall by a tool such that the cooling air is blown in the direction of the downstream combustion chamber wall. The cooling air holes can here be purely axial or also have a circumferential component. An advantageous angular range is, however, not specified. Besides, this US Specification describes the cooling of the combustion chamber wall as such, not the formation of the starter film.

In Publication EP 0 434 361 B1, a cooling film is produced in a step in the combustion chamber wall in that radially supplied air is impinged on a plate, thereby deflected by essentially 90 degrees, and blown out as film essentially parallel to the combustion chamber wall. Using a fin or vane-type arrangement, the cooling air is here directed tangential to the hot gases, in accordance with the direction of flow of the flame, or the exhaust gases in the combustion chamber. According to this Publication, the cooling air is thus blown in radially and deflected by 90 degrees. In addition, a circumferential component is imposed on the cooling air by way of which the flow is significantly slowed down. Also this Publication only describes the cooling of the wall, not the formation of the starter film.

In the solutions known from the state of the art, the starter film is produced in that a flow formed by many individual holes is equalized by impingement and deflection in a cooling ring (U.S. Pat. No. 5,279,127) or on the heat shield (DE 102 14 573 A1).

With this type of equalization, the starter film deliberately loses a major part of its speed or, to be more precise, its impulse. However, since the efflux of a burner is not subject to such retardation, the air leaving the burner has a larger impulse than the starter film air and is capable of displacing the latter at the combustion chamber wall sideward into the areas between the burners. The flame stabilizing downstream of the burner will accordingly burn very closely to the combustion chamber wall. The strong deflection on the rear side of the heat shield or within the cooling ring, respectively, generates longitudinal swirls, as a result of which hot gas rapidly mixes with the starter film. Consequently, the temperature of the latter will quickly rise and the protective effect be reduced accordingly.

Moreover, the starter film air will accumulate in the area between the burners. Accordingly, the heat input into the combustion chamber wall will spatially periodically increase with each burner and again decrease in the interspaces, resulting in a temperature variation in a circumferential direction in the combustion chamber wall. In addition, the temperature limit of the material cannot be transgressed, even at the point of maximum loading of the combustion chamber wall. Accordingly, the maximum loaded point on the circumference determines the necessary air quantity of the starter film. This means that the combustion chamber will needlessly be cooled strongly in the area between the burners by cold streaks of air intended for the hot combustion chamber wall on the burner axis. Such unadjusted cooling results in a significant temperature variation of the combustion chamber wall in the circumferential direction, with the consequence that strong mechanical stresses occur in the combustion chamber wall. These stresses entail a significant reduction of the service life of the combustion chamber wall.

The short fins, as specified for example in Specification DE 4427222 A1 or DE 19508111 A2, leave a major radial gap to the combustion chamber wall, allowing compensating flows to form in the circumferential direction which lead to a shift in the mass flow distribution provided via the starter film holes. How much starter film air is issued at which circumferential position is accordingly no longer controlled by the design alone, but also by the flow field.

A broad aspect of the present invention is to provide a gas turbine combustion chamber with starter film for cooling the combustion chamber wall of the type specified at the beginning above, which ensures reliable starter film formation and optimized temperature distribution, while being simply designed and cost-effectively producible.

The present invention accordingly provides for an arrangement, in which the center axes of the openings for passing the cooling air are inclined at a shallow angle relative to the combustion chamber wall.

Figure 2:
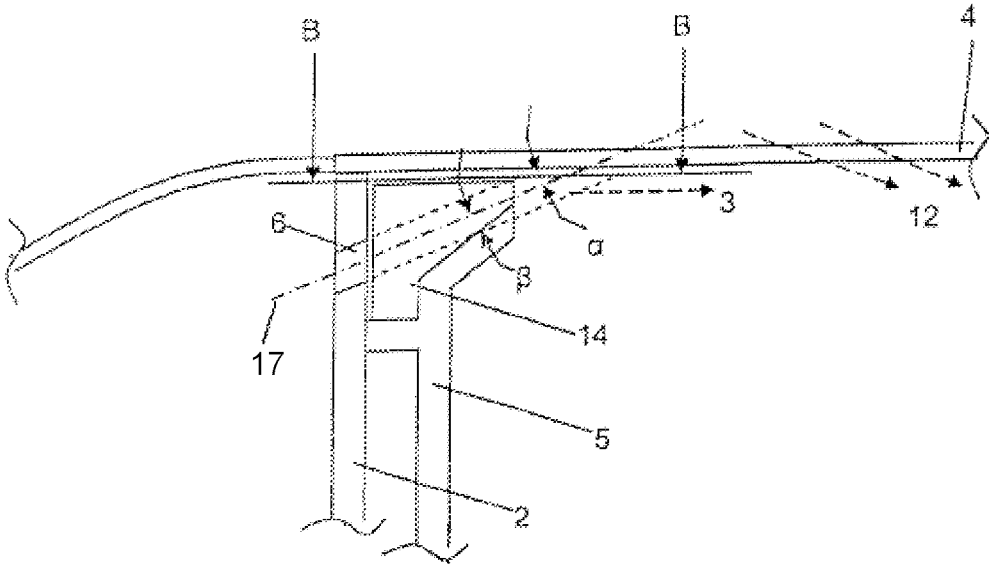
Figure 3:
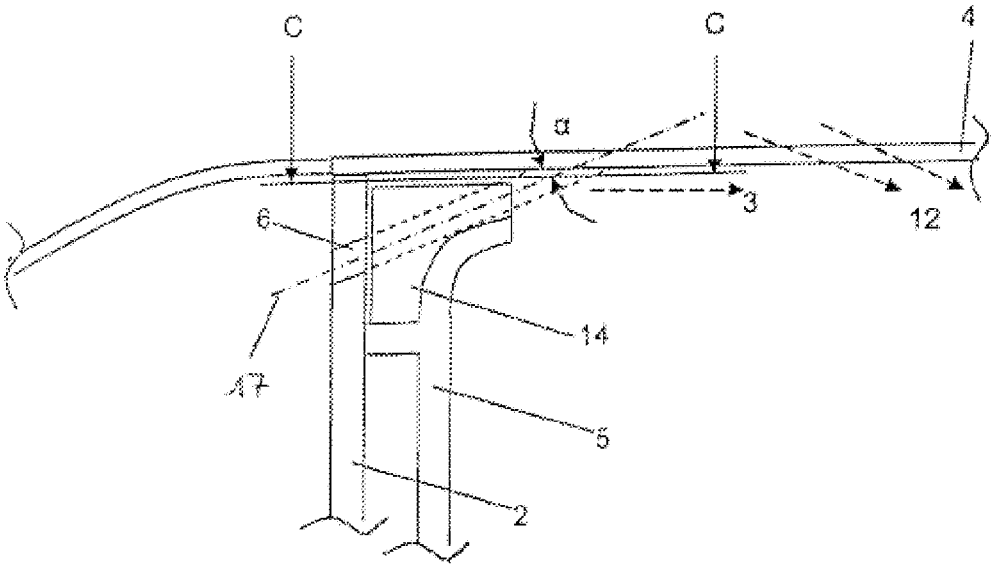
Figure 4:
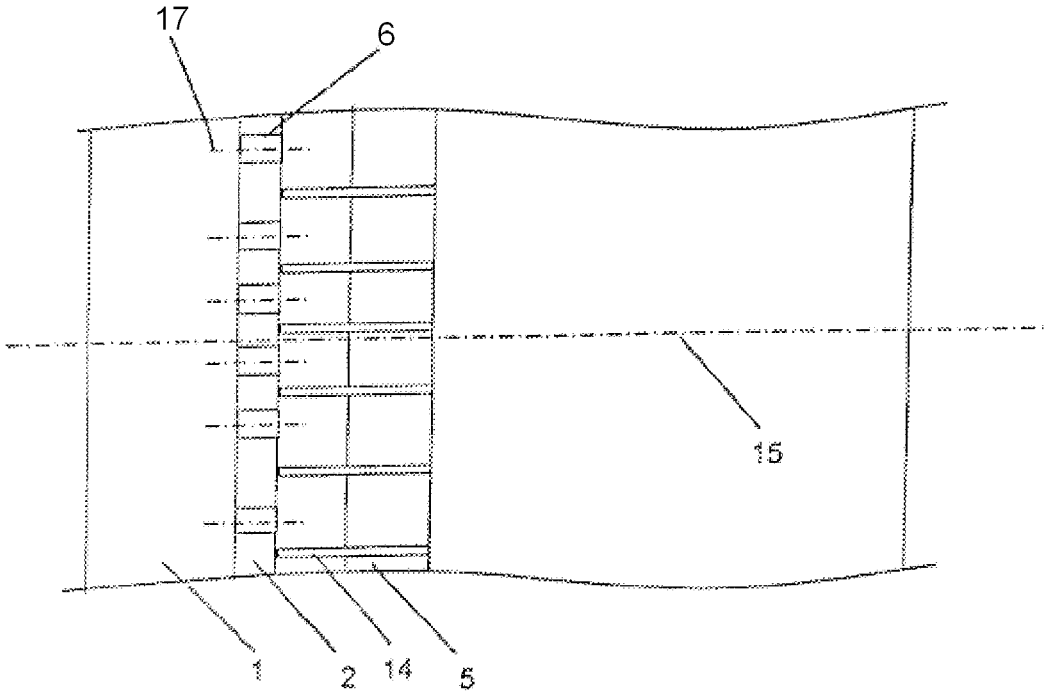
Figure 5:
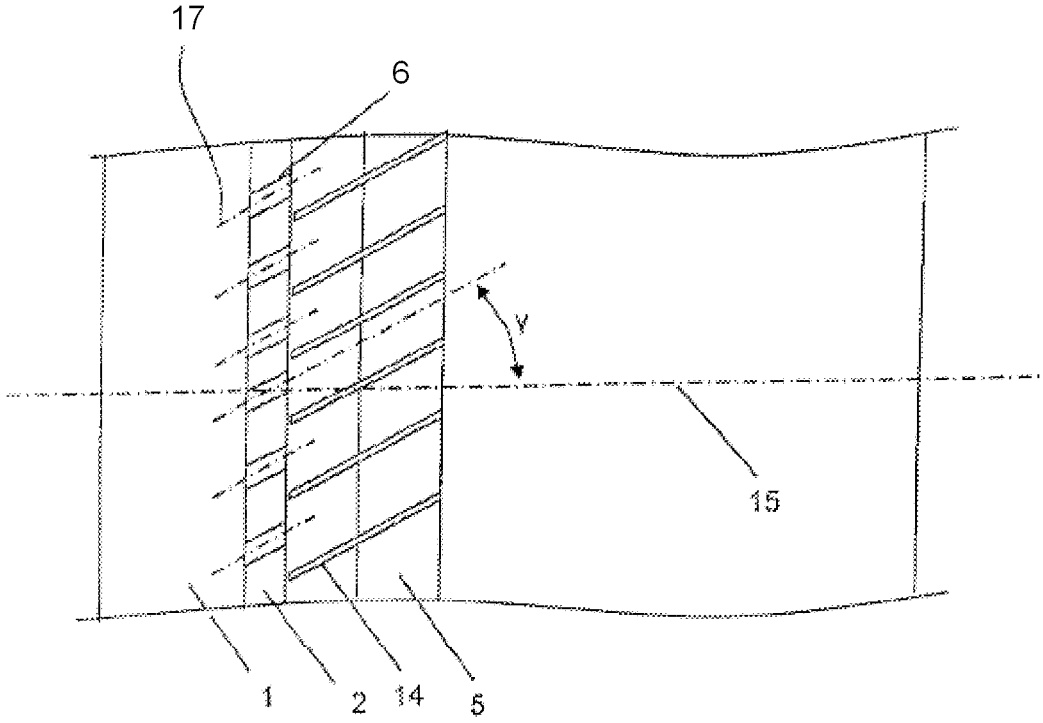
Figure 6:
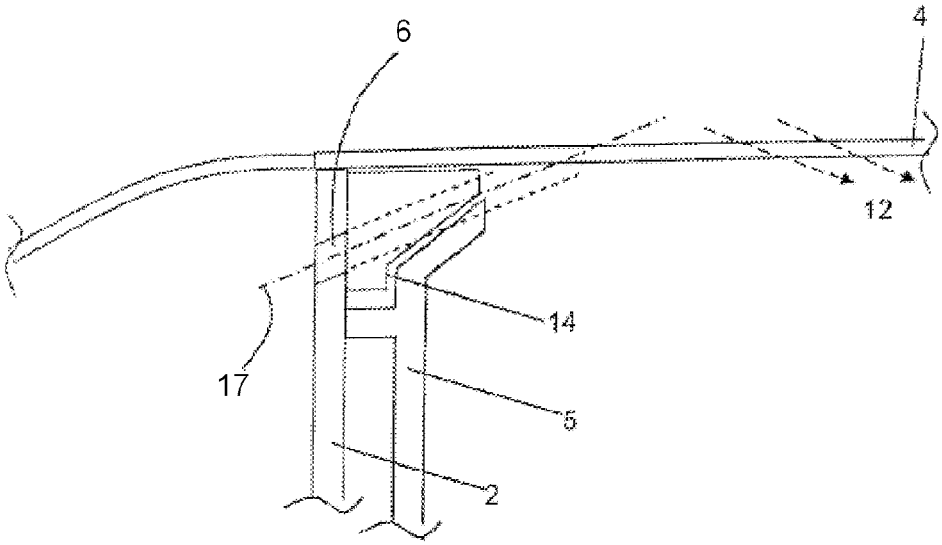
Figure 7:
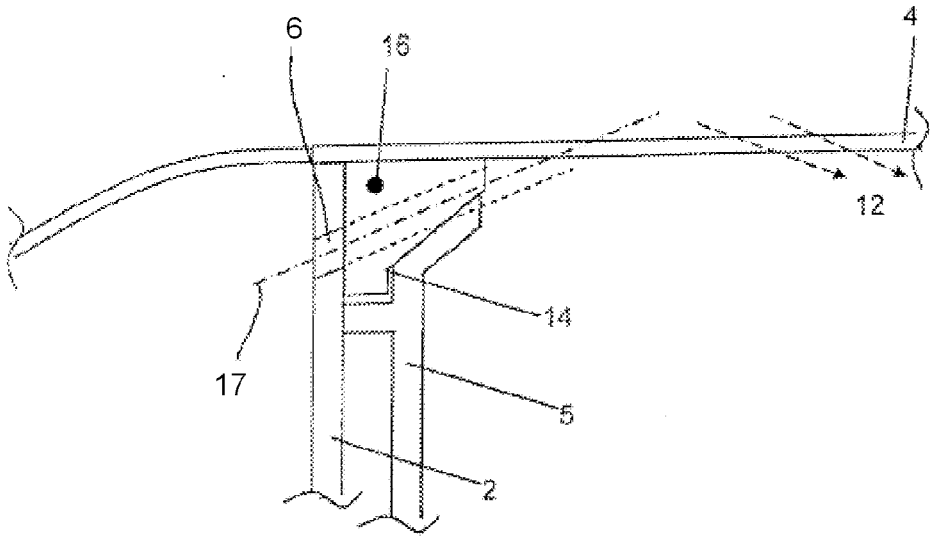
Figure 8:
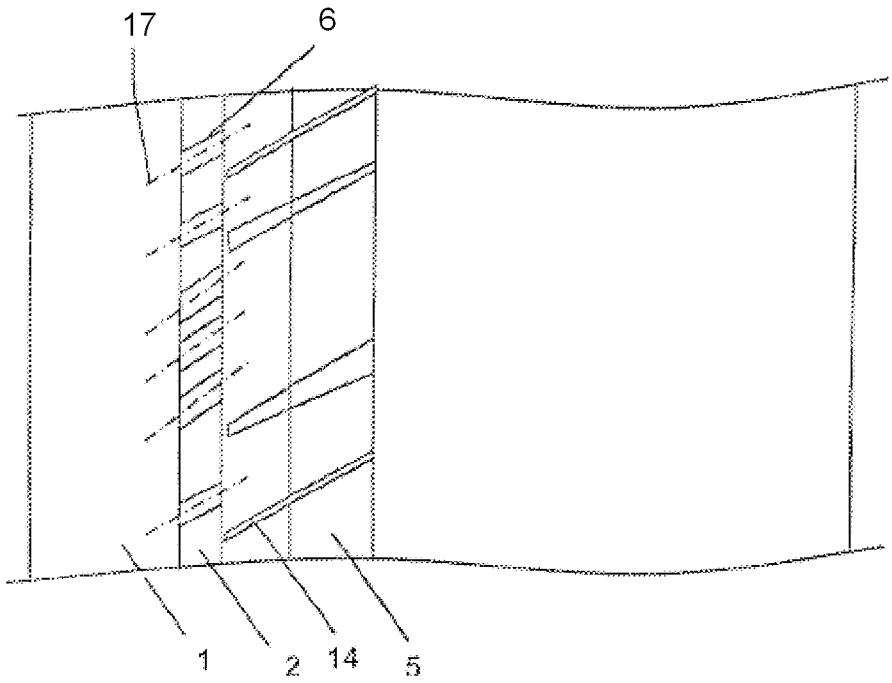

The present invention is more fully described in light of the accompanying drawings showing preferred embodiments. In the drawings, FIG. 1 is a schematic cross-sectional view of a gas turbine combustion chamber in accordance with the state of the art, FIG. 2 is a schematic representation, as per detail A of FIG. 1, of a first example in accordance with the present invention, FIG. 3 is a representation, analogically to FIG. 2 of a further example in accordance with the present invention, FIG. 4 is a radial view in merely axial alignment as per view B-B of FIG. 2, FIG. 5 is a radial view with angle in circumferential direction as per view C-C of FIG. 3, FIG. 6 is a further example, analogically to FIGS. 2 and 3, FIG. 7 is a further example, analogically to FIGS. 2 and 3, and FIG. 8 is a further variant, analogically to the representations of FIGS. 4 and 5.

According to the present invention, the air intended for the formation of the starter film will not be strongly deflected upon passing the narrowest location, i.e. the opening 6 in the base plate 2, in which it is accelerated to the speed corresponding to the pressure drop. This weak deflection is, according to the present invention, described by the existence of an intersection between the center axis 17 of the starter film opening 6 and the combustion chamber wall 4 (FIGS. 2 and 3) and an angle $\alpha$ smaller than 30 degrees. The strongest deflection must take place on the component on which the maximum film cooling effect is to be achieved, i.e. the hot side of the combustion chamber wall 4 where the air flowing to the wall is deflected in wall-parallel direction.

In an advantageous development of the present invention, the flow will come into contact with another surface before reaching the hot side of the combustion chamber wall 4, for example the rear side of the heat shield 5 or within the cooling ring forming the starter film. There, the deflection angle $\beta$ is preferably smaller than or at most equal to the deflection on the combustion chamber wall 4 described by the angle $\alpha$. This deflection angle $\beta$ is measured as an angle between the center axis 17 of the jet of a starter film opening 6 and the surface of the component 5 at a point where the projection of the starter film opening 6 meets this component 5.

Furthermore, the two deflections, i.e. on the heat shield 5 and on the hot side of the combustion chamber wall 4, preferably have opposite directions of rotation. The angle of deflection of the starter film jet on the combustion chamber wall (measured as the angle between the center axis 17 of the starter film opening 6 and the hot-side surface of the combustion chamber wall 4) shall according to the present invention not exceed 30 degrees, and is preferably limited to less than 20 degrees, with 5 to 15 degrees being provided in a favorable embodiment.

As a variant of the present invention, the projection of the wall of the starter film opening in the direction of the combustion chamber wall 4 touches the heat shield 5 at only one point, or the projection extends as a tangent to the heat shield contour. In either case, there is no real intersection of the projection with the heat shield contour (see FIG. 3), so that a deflection in the proper sense does not take place there. The angle $\alpha$ of the deflection of the starter film 3 on the combustion chamber wall 4 (measured as the angle between the axis of the starter film opening 6 and the hot-side surface of the combustion chamber wall 4) shall according to the present invention not exceed 30 degrees, and is preferably limited to less than 20 degrees, with 5 to 15 degrees being provided in a favorable embodiment.

In a favorable development of the present invention, fins 14 are provided on that part of the heat shield 5 on which the air for the starter film 3 is conducted which essentially are oriented in accordance with the intended direction of flow and radially extend inwards and outwards beyond the starter film lip, see FIGS. 2 and 3 as well as FIGS. 4, 5, 6 and 7. The direction of flow is determined by the direction of projection of the starter film openings 6 in the direction of the combustion chamber wall 4. This means that the fins will not significantly deflect the air in the circumferential direction.

For further increasing the cooling effect, the openings 6, which form the narrowest cross-section, will be inclined not only radially, but also circumferentially, see FIG. 5. The angle $\gamma$ between the axial direction of the engine and the axis of the opening is according to the present invention less than 60 degrees, preferably 30 to 45 degrees. In order to support this circumferential component, the fins 14 are provided on that part of the heat shield 5 which conducts the air for the starter film. According to the present invention, these will however not deflect the air in the circumferential direction, but the circumferential component is essentially produced by the cooling openings 6 and only preserved by the fins 14.

The fins can be disposed on both the cold side of the heat shield (FIGS. 2 and 3) and the downstream side of the base plate 2, see FIG. 6, or the inner side of the combustion chamber wall 4. The fins can be integrally joined with the heat shield 5 or the base plate 2 or the wall 4, respectively, or be form-locked or frictionally-locked with one another. Since the fins 14 are not required to produce deflection of the flow and, therefore, no major forces are involved, they may also be arranged as separate component between the heat shield 5 and the base plate 2 as well as the combustion chamber wall 4, provided that the direction and spacing of the fins 14 is set as required by disposing a suitable connecting element between the individual fins 14, for example a brazed-in wire, see FIG. 7.

In a favorable development of the present invention, the starter film openings 6 can individually or group-wise vary in the size of their circumferential angle $\gamma$, see FIG. 8, with the fins then intermediating between these two directions by way of a thickness variation in the direction of flow. If the starter film openings are facing away from each other, the fins 14 have increasing thickness in the direction of flow or, respectively, if the starter film openings are facing towards each other, the fins 14 have decreasing thickness in the direction of flow. Also in this case, according to the present invention, the principle is maintained that the direction of the flow is not controlled by the fins 14, but is defined by the direction of the starter film openings 6, and essentially only preserved by the fins.

According to the present invention, the direct relation between starter film openings 3 and fins 14 can be departed from to further improve the cooling of the combustion chamber wall or save manufacturing costs or weight, see FIG. 8. Accordingly, single or several fins 14 can be omitted between two starter film openings.

The speed of the starter film air 3 is kept close to the maximum speed at the opening 6 in the combustion chamber wall. The cooling film produced on the hot side of the combustion chamber wall 4 retains its high impulse and is capable of displacing the flame of the burner from the wall 4. Moreover, owing to the limitation of the deflection angle, longitudinal swirls are produced to only a small extent, thereby providing for drastically reduced mixing of hot gas and starter film air.

If two deflections take place, but have opposite direction of rotation, the resulting longitudinal swirls will likewise rotate in opposite direction and ideally can cancel out, but not augment each other.

As a result of the additional speed of the cooling film in the circumferential direction, the difference in the direction of flow between the starter film and the efflux of the burner or, respectively, the direction of flow in the flame is reduced, this providing again for reduced mixing of flame and starter film.

Owing to the fins 14 extending to near the wall 4, compensating flows behind the heat shield 5 in circumferential direction are avoided, and the air quantity issued at a certain circumferential position is precisely approachable to the quantity there required for cooling. The starter film air flows over the wall in the area of the maximum thermal wall loading and, owing to the very small degree of mixing with the hot gas over a large running length, ensures a low wall temperature on the burner axis. Since no starter film air 3 is displaced from the burner axis, no cold air streaks and no overcooled strips between the burners will occur. The temperature gradient in the circumferential direction and, thus, the thermally induced stress in the combustion chamber wall is drastically reduced, with service life being increased at a given temperature for a specific material. Accordingly, this also enables the operating temperature of a component to be increased for a specific material with service life remaining the same, or a change to a weaker and less expensive material may be made with temperature and service life remaining unchanged.

LIST OF REFERENCE NUMERALS

1 Cover of combustion chamber head
2 Base plate
3 Starter film, starter film opening, cooling airflow
4 Combustion chamber wall
5 Heat shield with hole for burner
6 Opening of base plate 2 (starter film opening)
7 Burner with burner arm and swirler
8 Turbine stator vane
9 Stator vane in compressor outlet
10 Combustion chamber outer casing
11 Combustion chamber inner casing
12 Wall cooling
13 Pitch circle of starter film
14 Fin between heat shield 5 and base plate 2
15 Engine axis
16 Connecting element between fins 14
17 Center axis of opening 6
$\alpha$ Radial angle between the direction of the starter film opening 6 and the combustion chamber wall 4
$\beta$ Radial angle between the direction of the starter film opening 6 and the direction of the surface of the heat shield 5
$\gamma$ Angle between the direction of the starter film opening 6 and the engine axis 15

What is claimed is:

1. A gas turbine combustion chamber comprising:
a combustion chamber wall forming a combustion chamber;
a combustion chamber head, into which cooling air can be introduced;
a heat shield positioned between the combustion chamber head and the combustion chamber;
a base plate having an outer rim area that is connected to a surface of the combustion chamber wall to define a forward end of the combustion chamber, the base plate being arranged at a certain distance from the heat shield and including a plurality of openings in the rim area for passing the cooling air to create a cooling air jet from each of the plurality of openings to form a starter film for cooling the combustion chamber wall, wherein a center axis of each opening is inclined at a shallow angle $\alpha$ relative to the combustion chamber wall, and each opening is constructed and positioned such that a straight line parallel to the center axis of the opening can pass through an entire length of the opening in a direct and unobstructed path from the cooling air in the combustion chamber head to the combustion chamber wall.

2. The gas turbine combustion chamber of claim 1, wherein a cooling airflow is conducted via the openings in the direction of flow onto a deflection area, which is provided at a shallow angle $\beta$ for deflecting the cooling air and at the angle $\alpha$ for supplying the cooling air.

3. The gas turbine combustion chamber of claim 2, wherein the angle $\alpha$ is smaller than 30 degrees.

4. The gas turbine combustion chamber of claim 3, wherein the angle $\alpha$ is smaller than 20 degrees.

5. The gas turbine combustion chamber of claim 4, wherein the angle $\alpha$ ranges between 5 degrees and 15 degrees.

6. The gas turbine combustion chamber of claim 5, wherein the deflection area is provided by the heat shield.

7. The gas turbine combustion chamber of claim 5, wherein the deflection area is provided by a cooling ring.

8. The gas turbine combustion chamber of claim 1, wherein the center axes of the openings are radially inclined.

9. The gas turbine combustion chamber of claim 1, wherein the center axes of the openings are circumferentially inclined at an angle $\gamma$.

10. The gas turbine combustion chamber of claim 9, wherein the angle $\gamma$ is smaller than 60 degrees.

11. The gas turbine combustion chamber of claim 10, wherein the angle $\gamma$ ranges between 30 degrees and 45 degrees.

12. The gas turbine combustion chamber of claim 1, and further comprising fins provided at the heat shield for conducting the cooling airflow.

13. The gas turbine combustion chamber of claim 12, wherein the fins are provided at the combustion chamber wall.

14. The gas turbine combustion chamber of claim 12, wherein the fins are provided at the base plate.

15. The gas turbine combustion chamber of claim 12, wherein the fins have a non-constant wall thickness along the flow.

* * * * *